United States Patent [19]

Wenzl

[11] 4,140,575

[45] Feb. 20, 1979

[54] ROLLER FRAME, PARTICULARLY FOR THE PRESS PORTION OF A PAPER MACHINE

[75] Inventor: Franz Wenzl, Graz, Austria

[73] Assignee: Escher Wyss GmbH, Fed. Rep. of Germany

[21] Appl. No.: 661,668

[22] Filed: Feb. 26, 1976

Related U.S. Application Data

[63] Continuation of Ser. No. 279,252, Aug. 9, 1972, abandoned.

[30] Foreign Application Priority Data

Aug. 18, 1971 [AT] Austria ..... 7224/71

[51] Int. Cl.[2] ..... D21F 1/26; D21F 3/02

[52] U.S. Cl. ..... 162/273; 162/358

[58] Field of Search ..... 162/272, 273, 274, 199, 162/200, 354, 358; 100/160, 168

[56] References Cited

U.S. PATENT DOCUMENTS

| | | | |
|---|---|---|---|
| 3,186,902 | 6/1965 | Grater | 162/273 |
| 3,378,435 | 4/1968 | Loynd | 162/273 |
| 3,547,776 | 12/1970 | Curtis | 162/274 |

*Primary Examiner*—Richard V. Fisher

*Attorney, Agent, or Firm*—James E. Bryan

[57] ABSTRACT

This invention relates to an improvement in a roller frame including a cantilever structure supporting a roller, particularly in the press portion of a paper machine. The improvement comprises support means pivotally mounted on said frame and supporting one end of said cantilever.

3 Claims, 4 Drawing Figures

FIG. 3
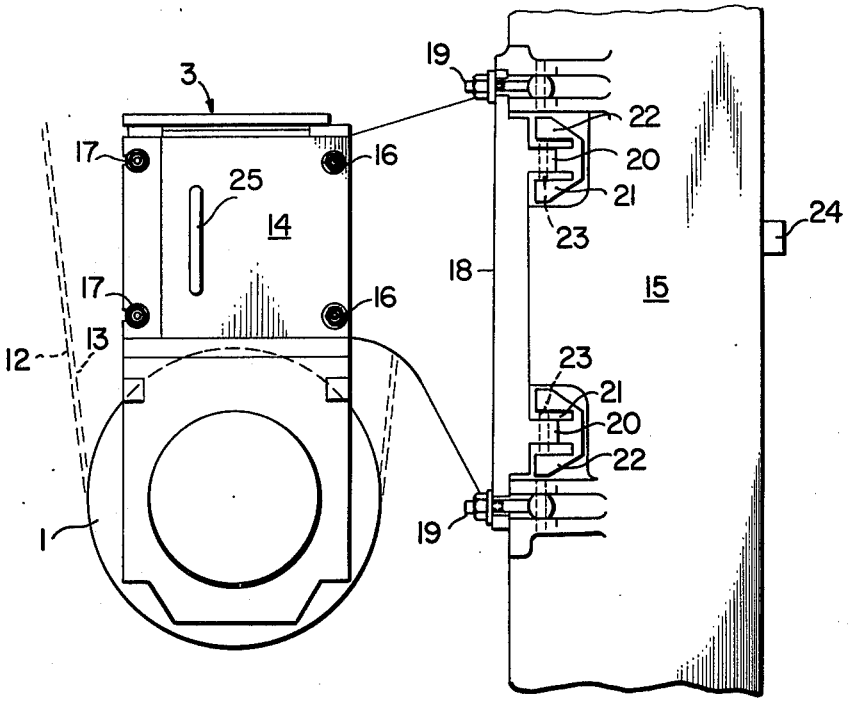
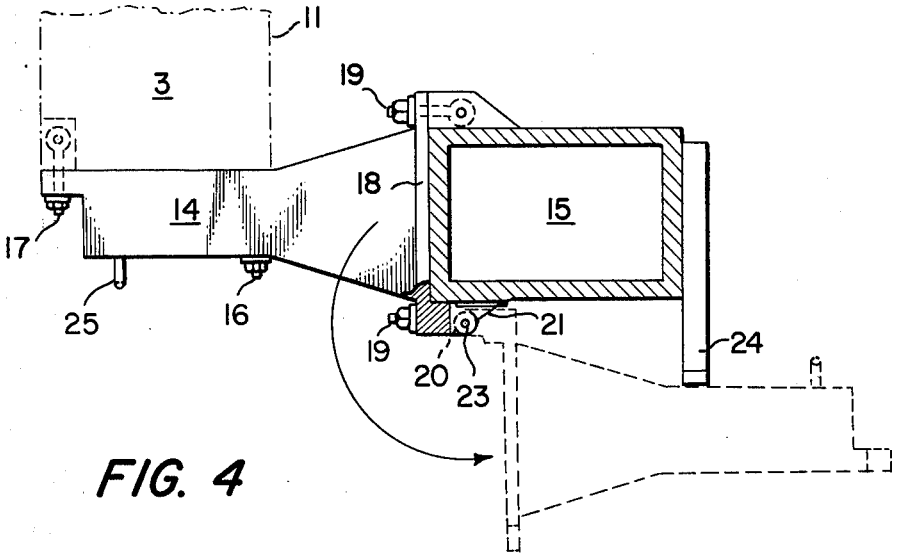
FIG. 4

ROLLER FRAME, PARTICULARLY FOR THE PRESS PORTION OF A PAPER MACHINE

The present invention relates to a roller frame, particularly for the press portion of a paper machine. Even though the present invention will be described hereinbelow in connection with the use thereof on such a press portion, it also may be employed for similar machines in the textile industry, or for the manufacture of plastic foils, and specifically in all cases where it is advantageous to make one end of the roller freely accessible, for example in order to exchange the roller, in order to renew the covering thereof, or in order to exchange a cloth rotating around the roller, for instance a felt or a sieve which consists, for example, of a fine wire mesh or of plastic.

This problem arises, for example, in connection with the press portion of a paper machine when the upper or the lower press rolls are involved around which a felt is externally arranged, with a sieve or screen being provided thereunder, in order that the web of paper coming from the Fourdrinier is pressed for the purpose of the water removal or discharge. This pressing effect may be in the order of 100 kg/cm of roller contact.

In such arrangements, the so-called cantilever construction is known in the art, in which this cantilever receives the roller bearing parts and, with the end thereof on the undriven side, is connected by way of a roller frame to the main post or support of the press portion. At the driven end of the roller the cantilever is extended beyond the roller end and is adapted to be clamped thereat by means of a pressure chock for the purpose of holding the roller end on the undriven side in a self-supporting fashion when it is removed from the frame. Such a removal or dissassembly is necessary when - as mentioned hereinabove - for example the sieve and/or the felt have to be exchanged.

A long disassembly time was necessary heretofore in order to remove a roller frame from a cantilever and from the coordinated main post or support.

In order to reduce the time of this time-consuming and therefore most uneconomical disassembly, which requires that the entire production apparatus be brought to a standstill, to a fraction of the length needed to date, in the roller frame as proposed by the present invention the end of the cantilever on the undriven side is carried by a pivotally arranged bearing part which is adapted to be turned away from the cantilever end, preferably about 180°. After unscrewing just a few fastening nuts, and once the cantilever has been clamped by means of the pressure chock in the customary manner, the bearing part may thus be turned away in its entirety, preferably about a vertical pivot axis, so that the cantilever and roller end will be free within a very short period of time and the exchange of the sieve and/or felt can be accomplished easily and rapidly, whereupon the bearing part is adapted to be returned into the supporting position thereof in an equally simple fashion and so that, after the tightening of the fastening nuts thereof, the cantilever end at the driven side can be relieved again.

Further features and advantages of the present invention will become apparent from the following description of a preferred embodiment thereof, taken in connection with the accompanying drawings, wherein FIG. 1 is a side view of a press portion from which all elements have been omitted that are of no significance as far as the present invention is concerned;

FIG. 3 is a side view of the roller frame constructed as proposed by the present invention, and Fig. 4 is a top plan view thereof, wherein the pivoted-out position of the bearing part has been indicated in phantom.

Figure 2:
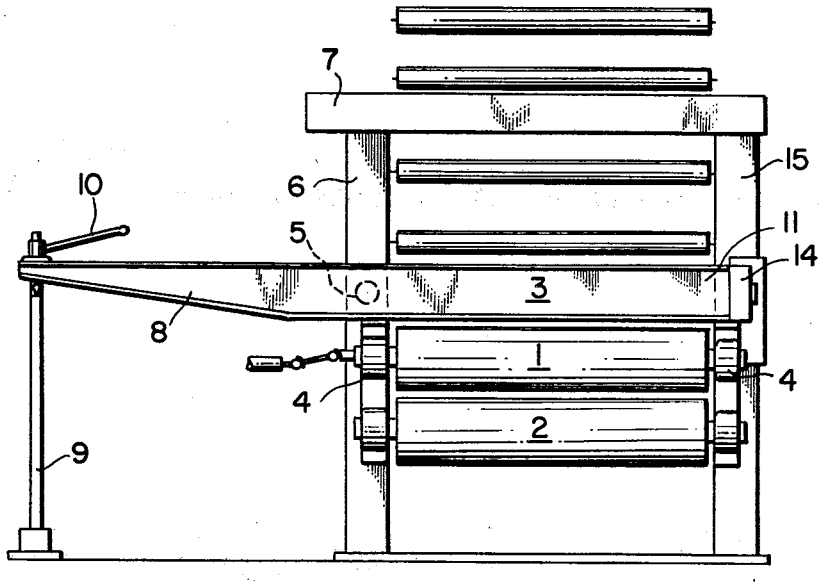
FIG. 2 is the coordinated cross-sectional view taken along line II—II of FIG. 1.
Figure 1:
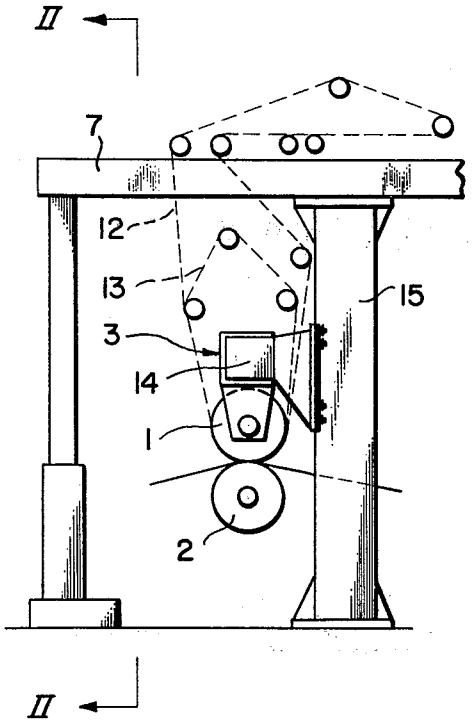

As is apparent from FIGS. 1 and 2, the press portion has a top roll 1 and a bottom roll 2, and guided or passed through therebetween is the web of paper (not shown) in order that the water be squeezed out of it. The top roll 1 is supported by conventional axle bearings 4 at the underside of the cantilever 3. As is apparent from FIG. 2, the cantilever is supported approximately in the center thereof by a pivot bearing 5 which is mounted in the post or support 6 of the main frame 7, on the driven side, and has a horizontal axis. The end 8 of the cantilever on the driven side which projects laterally by approximately the width of the roll is adapted to be bolted or locked be means of a pressure chock 9 with a bolt or gripping lever 10 so as to maintain the end 11 at the undriven side freely supporting during the exchange of the felt or of the sieve.

In the embodiment illustrated in the drawing, there are present both such a felt 12 on the outside, and therebelow a plastic sieve or screen 13, both of which are guided over the outside of the top press roll 1 and whose course is indicated, in dashed lines in FIG. 1, over the various conventional rollers of the press portion.

The end 11 of the cantilever on the undriven side is supported in a separate bearing part 14, forming the roller frame proper, at the undriven side post or support 15 of the main frame. In the normal carrying or supporting position, this bearing part or element 14 is connected, via a pair of threaded studs and nuts 16 in the center thereof and a pair of eye-bolts 17 at the left end thereof (in FIG. 1), with the end face of the cantilever 3. The supporting plate 18 of the bearing part or element 14 is fixed in position at the undriven side post or support 15 via four eye-bolts 19. In addition thereto, the supporting plate 18 has two lug portions 20 which are disposed in alignment with vertical bores, guided by upper and lower side bars or clips 21 at a base plate 22, and connected thereto by means of bolts 23. The base plates 22 of the pivot bearing thus formed and having a vertical pivot axis are fixed in position at the post or support 15. The post or support 15 further carries, at the lateral surface thereof adjacent the base plates 22, a stop 24 which delimits the pivoting movement of the bearing part or element 14.

During the exchange of the felt 12 or of the sieve or screen 13, the operation and procedure are as follows - Initially, the cantilever 3 is clamped by means of the lever 10 in the pressure chock 9 so that the undriven side end 11 thereof is adapted to carry itself and the roll 1 without additional support. Thereupon the nuts on the studs 16, 17 at the end face of the cantilever are unscrewed, and also the nuts on the bolts 19 at the post or support 15. In this position, the bearing part or element 14 is held only by the upper and lower pivot bearings 20–23 and may then be easily pivoted about 180° in a horizontal plane by means of a handle 25 disposed at the lateral surface thereof, and specifically - as is apparent from FIG. 4 - away from the end 11 of the cantilever 3 until making contact with the stop 24. As a result, the cantilever 3 and the upper roll 1 being supported thereby are free from the main frame 7 and the cloth 12 and/or the sieve or screen 13 may be easily removed laterally and, respectively, reinserted. For purposes of closing the bearing part, the reverse order of operations is analogously carried out.

Within the concept or framework of the present invention changes regarding the embodiment described hereinabove are possible. Particularly, it is not mandatory to provide a vertical axis of rotation for the bearing part or element 14. It instead could be provided also either horizontal or inclined. The guide and locking of the bearing part or element at the main frame 7 may be established in any manner desired.

It will be obvious to those skilled in the art that many modifications may be made within the scope of the present invention without departing from the spirit thereof, and the invention includes all such modifications.

What is claimed is:

1. In a roller frame including a cantilever structure supporting a roller, particularly in the press portion of a paper machine, the improvement which comprises flap hinge means mounted on said frame and having bearing means therein adapted to support one end of said cantilever.

2. A roller frame according to claim 1 in which said flap hinge means is mounted on said frame by pivoting means having a vertical axis of rotation.

3. A roller frame according to claim 1 in which said flap hinge means is connected to said frame and said cantilever by easily detachable means.

* * * * *